United States Patent [19]

Mann

[11] 4,134,628

[45] Jan. 16, 1979

[54] DISPLAY FIXTURE

[75] Inventor: Leonard T. Mann, Wheaton, Ill.

[73] Assignee: Hart, Schaffner & Marx, Chicago, Ill.

[21] Appl. No.: 822,677

[22] Filed: Aug. 8, 1977

[51] Int. Cl.[2] ..... A47B 81/00

[52] U.S. Cl. ..... 312/239; 312/257 R; 312/257 SK; 108/111

[58] Field of Search ..... 312/239, 128, 129, 257 SK, 312/257 SM, 229; 108/111, 114; 52/236.6

[56] References Cited

U.S. PATENT DOCUMENTS

| | | | |
|---|---|---|---|
| 1,314,271 | 8/1919 | Kopp | 312/229 |
| 1,368,052 | 2/1921 | Powell et al. | 312/257 SK |
| 2,529,649 | 11/1950 | Coplen | 108/114 |
| 3,182,846 | 5/1965 | La Kaff | 312/257 R |
| 3,316,864 | 5/1967 | Maslow | 108/111 |
| 3,589,746 | 6/1971 | Inglis | 108/111 |
| 4,050,386 | 9/1977 | Kellogg | 108/111 |

FOREIGN PATENT DOCUMENTS

| | | | |
|---|---|---|---|
| 136174 | 2/1950 | Australia | 312/257 SK |
| 558462 | 6/1958 | Canada | 312/257 SK |
| 1196387 | 6/1970 | United Kingdom | 312/257 SK |

*Primary Examiner*—Victor N. Sakran
*Attorney, Agent, or Firm*—Kinzer, Plyer, Dorn & McEachran

[57] ABSTRACT

A display fixture of the etagere type having shelves arranged so that it can be trimmed with all the items of a complete clothing ensemble and which can also support a poster having a photograph of a model dressed in the clothing ensemble being displayed. The display fixture includes a base member and a top member of similar generally rectangular configuration which are connected by a plurality of wood uprights located at each corner of the base and top members. Additional uprights are located intermediate the corner uprights and are positioned on opposite sides of the fixture in alignment with one another and located closer to one end of the fixture than to the other end. The base and top members are each constructed of steel tubing of square transverse cross-section formed into a rectangular shaped ring. Stub portions located at the corners of the rectangular ring and intermediate stub portions extend at right angles to the plane of the rectangular ring. Openings located in the ends of the stub portions receive the uprights. Slatted shelves are supported on the uprights by means of shelf standards located in vertical grooves in the uprights and hooks seated in slots in the uprights. The hooks include shelf supporting bases which engage the shelves. The end walls of the shelves are deeper than the transversely extending slat members to prevent the shelves from sliding off the support hooks.

3 Claims, 10 Drawing Figures fig.5.
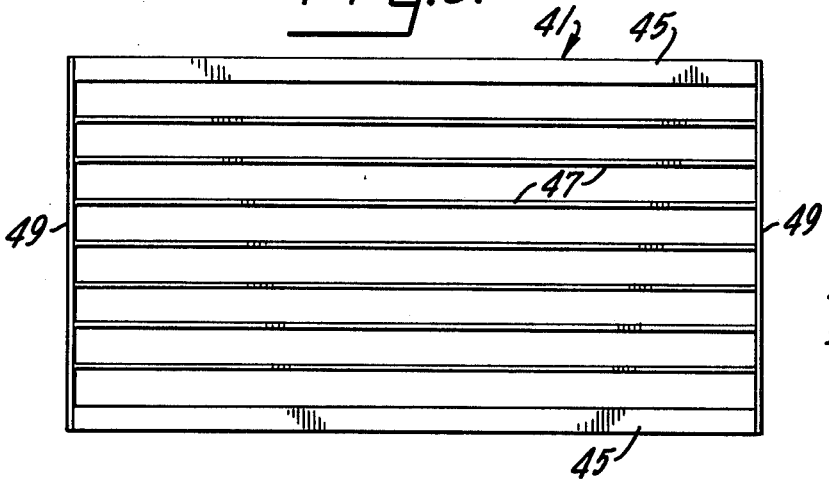
fig.9.
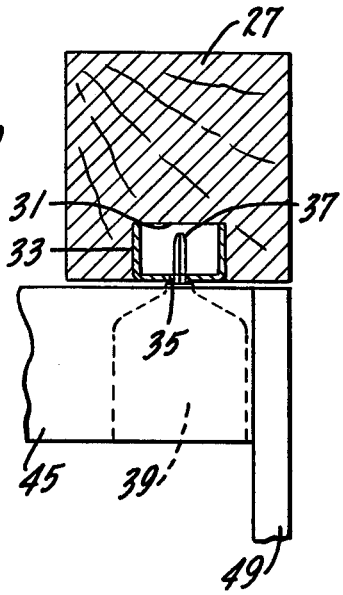
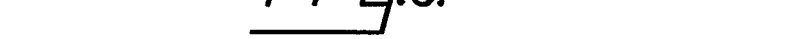
fig.6.
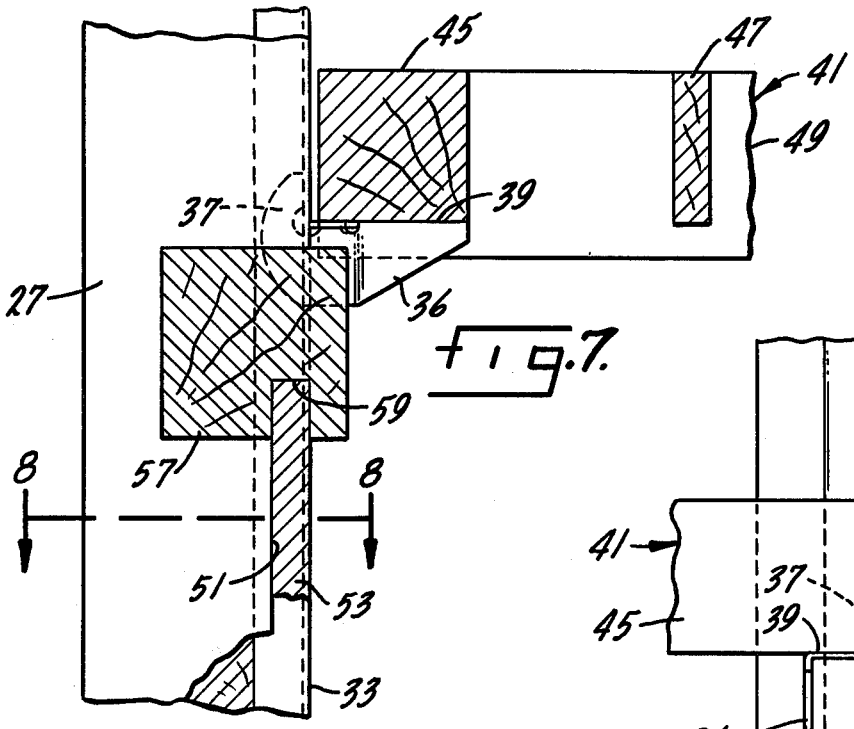
fig.7.
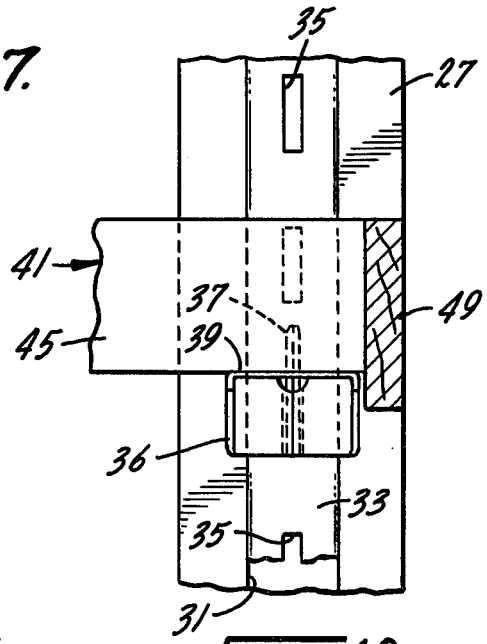
fig.10.
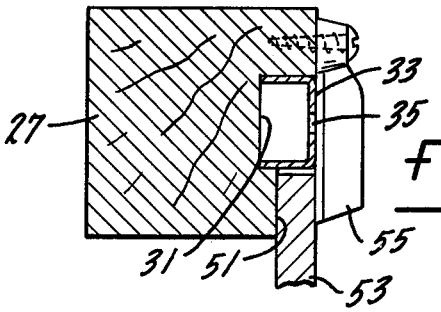
fig.8.

DISPLAY FIXTURE

BACKGROUND OF THE INVENTION

A modern merchandising concept involves the grouping of all items of a clothing ensemble in one display so that the prospective purchaser can see the "overall look" to be achieved. In the merchandising of men's clothing, this may involve the display of a coordinated ensemble consisting of such items as a suit coat, vest, slacks, shirt, tie, shoes, belt and other accessories. Previous display fixtures which were intended for the presentation of one or more items of an ensemble are not suitable for properly displaying all of the items of a complete ensemble. A previously and well known method of displaying an ensemble of clothing involved the use of a mannequin. As a result of the shift in merchandising from the conventional downtown store with its display windows to the shopping center store, especially the shopping center of the enclosed mall type where the stores open on an enclosed mall and have a minimum of visual impediments between the mall and the interiors of the stores, the use of display windows and mannequins have declined in importance and effectiveness. However, the declining use of mannequins has created a need for a display fixture that can effectively convey the impression of a complete and coordinated clothing ensemble to the prospective purchaser.

SUMMARY OF THE INVENTION

This invention is directed to a display fixture which can present a complete clothing ensemble in a most attractive and appealing manner.

A feature of this invention is a display fixture which can be used to present both large items of wearing attire such as a suit coat or a jacket as well as smaller items such as shoes, belts, neckties, etc.

Another feature of this invention is a display fixture which can support a large poster, especially a poster large enough to show a photograph of a model wearing the complete clothing ensemble being displayed.

Another feature of this invention is a display fixture in which the vertical spacing of the shelves can be varied.

Another feature of this invention is a display fixture having slatted shelves which can both support items and support hooks which in turn support items of attire.

Another feature is a display fixture which can be shipped in a disassembled state and can be assembled rather easily so that assembly can be accomplished by relatively unskilled personnel.

Another feature is a display fixture having shelves which are supported only by support brackets but which are prevented from accidentally sliding off the brackets.

Other features may be found in the following specification, claims and drawings.

BRIEF DESCRIPTION OF THE DRAWINGS

The invention is depicted in the following drawings wherein:

FIG. 5 is a top plan view of one of the shelves of the display fixture shown on an enlarged scale;

FIG. 6 is a side elevational view of the shelf of FIG. 5;

FIG. 7 is an enlarged partial view taken along lines 7—7 of FIG. 1;

FIG. 8 is a cross-sectional view taken along lines 8—8 of FIG. 7;

FIG. 9 is a partial top plan view on an enlarged scale showing a standard and support bracket for a shelf; and FIG. 10 is a partial front elevational view of the standard, bracket and shelf of FIG. 9.

DESCRIPTION OF THE PREFERRED EMBODIMENT

Figure 1:
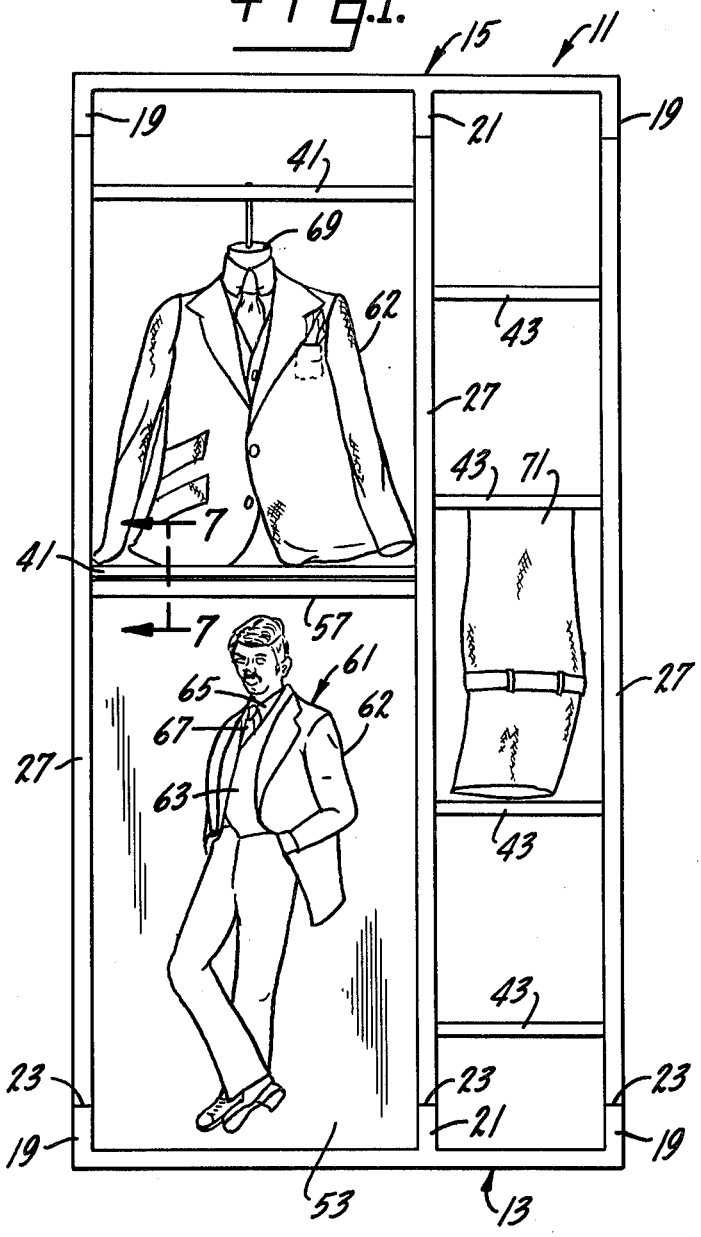
FIG. 1 is a front elevational view of a display fixture of this invention.
Figure 2:
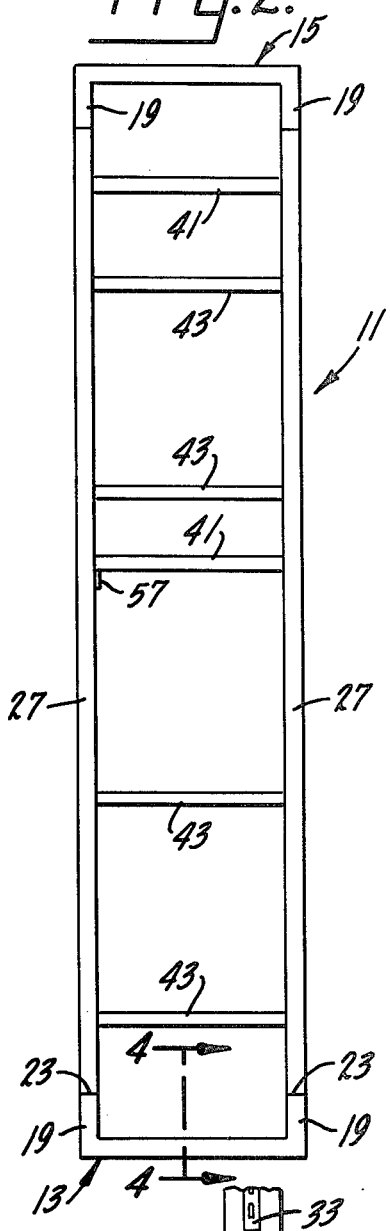
FIG. 2 is a side elevational view of the display fixture of FIG. 1.
Figure 3:
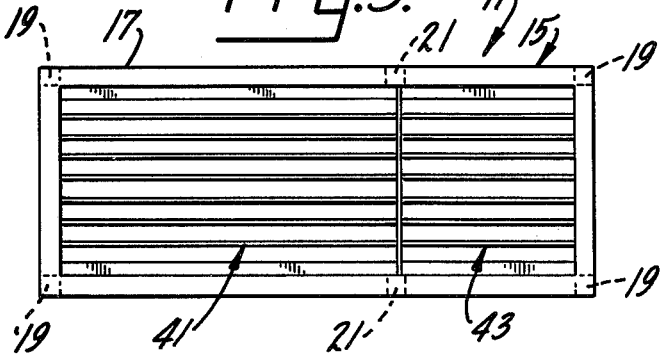
FIG. 3 is a top plan view of the display fixture of FIG. 1.

FIGS. 1, 2 and 3 of the drawings show front, side and top views of a display fixture or etagere 11 which embodies the novel features of this invention. The display fixture 11 includes a base member 13 and a top member 15 which are of substantially identical construction except that the base member may be equipped with round furniture guides, which are not shown in the drawings. The base and top members are each formed of steel tubing of square transverse cross-section welded into a rectangular ring 17.

In the preferred embodiment of the invention, the tubing has dimensions of approximately one and one-half inches by one and one-half inches. Of course, these dimensions may be varied depending upon the avilability of material as well as the size of and the use to which the display fixture is to be put. Stub portions 19 also formed of square steel tubing are positioned at each corner of the rectangular ring 17 and project at right angles to the plane of the ring. Additional stub portions 21 are located on the longer sides of the rectangular ring and are positioned intermediate the corner stub portions with the stub projections 21 on opposite sides of the rectangular ring aligned with each other. The intermediate stub portions are located closer to one end of the rectangular ring 17 than to the other end as can be most clearly seen in FIG. 1 of the drawings. Openings 23 of square cross-section are located at the outer ends of the stub portions.

Figure 4:
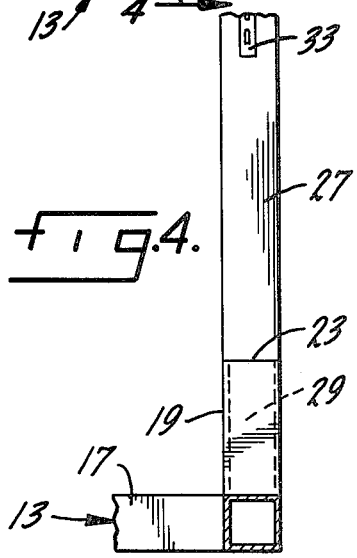
FIG. 4 is a view taken along lines 4—4 of FIG. 2 on an enlarged scale.

Uprights 27 extend between the base member 13 and the top member 15. The uprights are conveniently formed of wood and have tennoned ends 29 (FIG. 4) which fit into the openings 23 of the stub portions 19 and 21. The stub portions should have sufficient height to receive the tennoned ends of the uprights to the full extent of the tennoned portions. In the preferred embodiment of the invention, the uprights are formed of white oak having cross-sectional dimensions of approximately one and one-half inches by one and one-half inches.

As can be seen most clearly in FIGS. 8, 9 and 10, a groove 31 of rectangular cross-section is formed in each upright 27 and extends substantially the length of the upright. When the uprights are installed in the stub portions 19 and 21 of the base and top members, the grooves are positioned so as to be located on the inwardly facing sides of the uprights. A metal standard 33 of U-shaped transverse cross-section is positioned in each groove and fastened to its upright with the legs of the U-shaped standard engaging the bottom of the groove and the face of the standard flush with the inner surface of the upright. Evenly spaced slots 35 of rectangular shape are formed in the standards. The standards are positioned in the grooves of the uprights so that similar slots of the standards are aligned horizontally.

Shelf support brackets 36 are installed in the slots 35. These brackets, which are of a conventional design, each have a semi-circular hook 37 which fits into a slot 35 and engages the rear surface of the wall of a standard 33. Each bracket also includes a planar surface 39 which engages and supports the undersurface of a shelf.

The shelves are constructed in two sizes having the same depth but different lengths so as to be properly supported between the closer and farther spaced uprights 27 forming the display fixture 11. Both the longer shelves 41 and the shorter shelves 43 are constructed in a similar manner. A typical shelf 41 is shown in FIGS. 5 and 6. Each shelf has front and rear cross-members 45 formed of approximately one inch by one inch wood stock. Ribs or slats 47 of approximately one-quarter inch thickness and having a depth of approximately one inch are evenly spaced between the front and rear cross-members at a distance apart of approximately one and three-eight inches. Transversely extending side members 49 of approximately one-quarter inch thickness and one and one-quarter inch depth connect the ends of the cross-members 45 and the ribs 47. The side members 49 extend below the lower surfaces of the cross-members and the ribs and function as stops which engage the edges of the brackets 36 to prevent the shelves from being accidentally slid off the brackets.

The facing inner vertical edges of the more widely spaced uprights 27 on one side of the display fixture are rabbeted to a depth of approximately one-quarter inch and a width of approximately one-half inch as is most clearly shown in FIG. 8 of the drawings to form a recess 51 which can receive a poster 53. The poster is held in the recess by turn buttons 55 which are fastened to the same uprights. For decorative purposes, a top rail 57 of wood is placed on the top edge of poster. The rail has a slot 59 which receives the top edge of the poster. The front of the poster preferably includes a photograph 61 showing a model wearing the same clothing ensemble which is displayed on the fixture 11.

The versatility of the display fixture 11 of the invention can best be understood and appreciated by the following description of the assembly and trimming of the display fixture to show a man's clothing ensemble. In the assembly, the base member 13 is placed on the floor with its stub portions 19 and 21 projecting upwardly. The six uprights 27 are then inserted in the stub portions to the depths of their tennoned portions 29. The stub portions of the top member 15 are then fitted over the tennoned top portions of the uprights. The poster 53 is installed in the recesses 51 of the uprights 27 which define the wider space between uprights at the front of the display fixture. The turn buttons 55 are used to hold the poster in place. The top finishing rail 57 is slid down over the top edge of the poster.

A longer shelf 41 is installed immediately above the top finishing rail of the poster and another long shelf is installed near the top of the display fixture directly above the poster. Four shorter shelves 43 are then installed in the narrower portion of the display fixture with the vertical spacing between these shelves being determined by the articles of wearing attire to be displayed.

Since the ensemble worn by the model in the photograph of poster 53 includes a jacket 52, vest 63, shirt 65 and necktie 67, these items are dressed on a shoulder hanger 69 which is hung from one of the ribs 47 of the shelf 41 located at the top of the fixture above the poster 53. The relatively large vertical space between the upper shelf 41 and the lower shelf 41 permits the jacket 61 to hang with its lower portion resting on the shelf 41 immediately above the poster. A slack 71 is draped through one of the ribs of the second small shelf 43 of the display fixture. The slack is arranged so that the waistband is hanging down on the poster side of the display fixture. The bottom part of the slack will rest on the shelf 43 immediately below. Thus, it can be seen that the use of slatted or ribbed shelves 41 and 43 permits articles of clothing to be hung from the shelves with hangers, to be hung directly on or to rest on the shelves. The remaining shelves in the display fixture can be trimmed using shoes, accessories, neck wear, etc. which complete the clothing ensemble. The vertical distances between the shorter shelves can be adjusted to most effectively display these items.

I claim:

1. A display fixture including:

a base member and a top member of similar generally rectangular configuration, a plurality of uprights connecting said base member and said top member with an upright connecting each corner of said base and said top members, additional uprights extending between said base and top members and being located intermediate said corner uprights with said intermediate uprights being positioned on opposite sides of said fixture in alignment with one another and located closer to one end of said fixture than to the other end thereof, said base member and said top member each being constructed of tubing of square transverse cross-section forming a rectangular shaped ring, stub portions located at the corners of said rectangular ring and intermediate the corners with said stub portions extending at right angles to the plane of said rectangular ring and having openings located in the ends of said stubs, said openings being adapted to receive said corner and intermediate uprights in a telescoping relationship, shelves supported on said uprights with said shelves supported by means of shelf standards located in vertical grooves formed in said uprights and secured thereto, vertically spaced slots formed in said standards, shelf support brackets having hooks fitting in said slots with said brackets having shelf-supporting bases to engage the front and rear members of said shelves, said shelves being of rectangular shape having front and rear longitudinally extending members of generally square cross-sections, longitudinally extending slats spaced apart between said front and rear members, said front and rear members and said longitudinally extending slats being connected at their ends by transversely extending end members, said slats being narrower in width than said front and rear members, said end members extending below said front and rear members and said longitudinally extending slats to engage the shelf supporting bases of said brackets to prevent said shelves from sliding off said brackets.

2. The display fixture of claim 1 in which poster mounting means are formed on one set of uprights.

3. The display fixture of claim 2 in which said poster mounting means are located on the inside surfaces of said pair of uprights.

* * * * *